US012672668B2

(12) United States Patent
Balboni

(10) Patent No.: US 12,672,668 B2
(45) Date of Patent: Jul. 7, 2026

(54) APPLYING AN ADDITIVE FROM WITHIN DURING SHAPING OF A SHEET INTO A ROD

(71) Applicant: PHILIP MORRIS PRODUCTS S.A., Neuchatel (CH)

(72) Inventor: Matteo Balboni, Sala Bolognese (IT)

(73) Assignee: Philip Morris Products S.A., Neuchatel (CH)

( * ) Notice: Subject to any disclaimer, the term of this patent is extended or adjusted under 35 U.S.C. 154(b) by 328 days.

(21) Appl. No.: 18/030,712

(22) PCT Filed: Oct. 8, 2021

(86) PCT No.: PCT/EP2021/077886
§ 371 (c)(1),
(2) Date: Apr. 6, 2023

(87) PCT Pub. No.: WO2022/074208
PCT Pub. Date: Apr. 14, 2022

(65) Prior Publication Data

US 2023/0371577 A1 Nov. 23, 2023

(30) Foreign Application Priority Data

Oct. 9, 2020 (EP) ..... 20201034

(51) Int. Cl.
*A24C 5/18* (2006.01)
*A24C 5/01* (2020.01)

(52) U.S. Cl.
CPC ..... *A24C 5/1892* (2013.01); *A24C 5/01* (2020.01); *A24C 5/1807* (2013.01)

(58) Field of Classification Search
None
See application file for complete search history.

(56) References Cited

U.S. PATENT DOCUMENTS 4,979,521 A 12/1990 Davis
5,415,186 A * 5/1995 Casey, III ..... A24B 15/287 131/365
8,381,736 B2 2/2013 White
8,408,215 B2 4/2013 Libbra
(Continued)

FOREIGN PATENT DOCUMENTS

EP 0246107 A2 * 11/1987 ..... A24C 5/1828
EP 2016840 9/2011
(Continued)

OTHER PUBLICATIONS

PCT International Search Report and Written Opinion for PCT/EP2021/077886 dated Mar. 23, 2022 (16 pages).
(Continued)

*Primary Examiner* — Michael H. Wilson
*Assistant Examiner* — Daniel Edward Vakili
(74) *Attorney, Agent, or Firm* — Mueting Raasch Group

(57) ABSTRACT

A method for producing a rod (3) containing herbaceous material comprises the steps of: providing a sheet material (5) containing herbaceous material; shaping the sheet material into a rod-shape by conveying the sheet material along a conveying direction (7) through a funnel-shaped converging device (13); and dispensing an additive (21) onto the sheet material within the converging device.

18 Claims, 2 Drawing Sheets

(56) References Cited

U.S. PATENT DOCUMENTS

| | | | | |
|---|---|---|---|---|
| 10,492,522 | B2 | 12/2019 | Flynn | |
| 2009/0301503 | A1 * | 12/2009 | Peter | A24D 3/0212 131/284 |
| 2015/0164133 | A1 | 6/2015 | Davis | |

FOREIGN PATENT DOCUMENTS

| | | | | |
|---|---|---|---|---|
| EP | 3469923 | A1 * | 4/2019 | A24D 3/0204 |
| EP | 3222158 | | 5/2019 | |
| GB | 2229079 | | 9/1990 | |
| WO | WO 2011/033121 | | 3/2011 | |
| WO | WO 2020/174026 | | 9/2020 | |
| WO | WO 2021/018836 | | 2/2021 | |
| WO | WO 2021/058352 | | 4/2021 | |

OTHER PUBLICATIONS

International Preliminary Report on Patentability for PCT/EP2021/077886 dated Dec. 13, 2022 (18 pages).

* cited by examiner

APPLYING AN ADDITIVE FROM WITHIN DURING SHAPING OF A SHEET INTO A ROD

This application is a U.S. National Stage Application of International Application No. PCT/EP2021/077886 filed Oct. 8, 2021, which was published in English on Apr. 14, 2022, as International Publication No. WO 2022/074208 A2. International Application No. PCT/EP2021/077886 claims priority to European Application No. 20201034.4 filed Oct. 9, 2020.

The present disclosure relates to applying an additive, in particular a liquid, to a sheet material that is formed into a rod.

It is known from practice to supply sheet material to a shaping device to shape the sheet material into a rod. Such rods may be used in the production of smoking articles or other aerosol-generating articles.

It may be desirable to add one or more substances to the rod. For example, it may be desirable to add aerosol-generating substances or flavorful substances to the rod. There is a need for an efficient way of modifying the properties of a rod of sheet material by adding one or more substances.

According to an aspect of the invention, there is provided a method for producing a rod containing herbaceous material. The method comprises the step of providing a sheet material containing herbaceous material. The sheet material is shaped into a rod-shape by conveying the sheet material along a conveying direction through a funnel-shaped converging device. Within the converging device, an additive is dispensed onto the sheet material.

Providing the additive in the rod containing herbaceous material may facilitate heating the additive together with the herbaceous material, thereby facilitating release of substances, such as flavor components, from the additive.

The sheet material containing herbaceous material may be comparatively fragile. In particular, the sheet material containing herbaceous material may be more fragile than acetate fiber sheets, from which typical cigarette filters are made. Due to sheet material containing herbaceous material being comparatively fragile, it was unexpected that an additive could be dispensed onto the sheet material within the converging device without detrimental effects on the sheet material.

Dispensing the additive within the converging device may ensure that a high percentage of the dispensed additive or even (nearly) all of the dispensed additive is actually applied to the sheet material, thereby reducing waste of additive and contamination of equipment by the additive.

As the additive is dispensed onto the sheet material within the converging device, the additive may be dispensed onto the sheet material while the sheet material is shaped into the rod-shape. While the sheet material is shaped, the configuration of the sheet material may change, which may lead to an improved distribution of the additive over the sheet material. In particular, the additive may reach both sides (upper and lower sides) of the sheet material. The additive may enter folds in the sheet material created upon shaping the sheet material in the converging device.

A desired distribution of additive within the final rod-shape may be achieved by appropriately selecting the exact location of additive dispension within the converging device, for example. Dispensing the additive within the converging device may allow achieving a comparatively high additive concentration in the inner region of the final rod-shape with respect to a radial direction. By contrast, if the additive would, for example, be applied onto the final rod-shape after the rod-shape has left the converging device, the concentration of the additive might tend to always be high in radially outer regions of the rod-shape and low in radially inner regions of the rod-shape. Also, by contrast, if the additive would, for example, be sprayed onto the sheet material through a spray nozzle upstream of the sheet material entering the converging device, only one side (upper side or lower side) of the sheet material would be covered and there might be waste of additive due to some of the additive missing the sheet material.

The funnel-shaped converging device may comprise one or more walls that are engaged by the sheet material upon conveying the sheet material through the converging device. Contact between the one or more walls and the sheet material may reshape the sheet material, for example by one or more of bending, folding and compressing the sheet material.

The converging device may define a forming space through which the sheet material is conveyed. The forming space may at least partially be defined or delimited by one or more walls of the converging device.

The additive may comprise aerosol-generating substances, such as one or more of glycerin, glycerol, and propylene glycol, for example. The additive may comprise one or more flavorants, such as menthol, spearmint, peppermint, eucalyptus, vanilla, cocoa, chocolate, coffee, tea, spices (such as cinnamon, clove, and ginger), fruit flavorants, and combinations thereof. The additive may comprise nicotine.

The additive may be dispensed as a liquid. Dispensing the additive as a liquid may facilitate dispensing the additive. If the additive is dispensed as a liquid, distribution of the additive over the sheet material may be facilitated. The liquid may flow on the sheet material.

Preferably, the additive comprises methol. The additive may comprise menthol at a mass percentage of at least 40 percent, or of at least 50 percent, or of at least 70 percent, or of at least 80 percent, or of at least 90 percent, or of at least 95 percent. The additive may be pure menthol. Adding menthol may introduce a strong and attractive flavor component into the rod. Menthol may act as an aerosol-generating substance upon heating the rod. Menthol has a strong physical consistency and may be applied to the sheet material in a reproducible manner.

The sheet material may be a cast of a slurry containing herbaceous material or of a paste containing herbaceous material. The sheet material may be a cast leaf material, in particular a tobacco cast leaf material. The slurry or the paste may comprise one or more species of herbaceous material. Casting herbaceous material as a sheet allows the herbaceous material to be continuously supplied to the production process from a supply roll, for example.

The sheet material may comprise cut or ground herbaceous material. The cut or ground herbaceous material may, for example, comprise particulate herbaceous material having a particle size between 40 microns and 500 microns.

The herbaceous material may comprise homogenised plant material.

The herbaceous material may, for example, comprise tobacco material, or clove material, or a mixture of clove material and tobacco material. Tobacco material, or clove material, or a mixture of clove material and tobacco material may, but do not have to, account for 100 percent of the herbaceous material. The herbaceous material may comprise no tobacco particles and 100 percent clove particles, based on the dry weight of the herbaceous material. The herbaceous material may comprise between 10 percent and 60 percent by weight clove particles and between 40 percent and 90 percent by weight tobacco particles, more preferably between 30 percent and 40 percent by weight clove particles and between 70 percent and 60 percent by weight tobacco particles, based on the dry weight of the herbaceous material. The sheet material may, for example, comprise a total content of between 40 percent and 90 percent by weight tobacco particles and a total content of between 10 percent and 60 percent by weight clove particles, based on dry weight of the sheet material.

The sheet material may, for example, comprise one or more of eugenol, eugenol-acetate, and beta-caryophyllene. In particular, the sheet material may comprise at least 125 micrograms of eugenol per gram of the sheet material, on a dry weight basis; at least 125 micrograms of eugenol-acetate per gram of the sheet material, on a dry weight basis; and at least 1 microgram of beta-caryophyllene per gram of the sheet material, on a dry weight basis.

The sheet material may comprise at least one of cellulose fibers and glycerin. Cellulose fibers may strengthen the sheet material and make it more resistant to breaking or tearing. Glycerin may facilitate the production of aerosol upon heating the sheet material.

The sheet material may have a thickness of less than 1 millimeter, or of less than 0.5 millimeter, or of less than 0.2 millimeter, or of less than 0.1 millimeter, or of less than 0.05 millimeter. The sheet material may have a thickness of at least 0.001 millimeter, or of at least 0.01 millimeter, or of at least 0.1 millimeter. Sheet material having a comparatively low thickness may be easier to shape into the rod shape. Sheet material having a comparatively high thickness may be less likely to be torn or damaged upon dispensing the additive onto the sheet material.

The sheet material may be cast leaf material, in particular tobacco cast leaf material. Cast leaf material may be manufactured by grinding herbaceous material, in particular tobacco material, to powder. The powder may be mixed with adhesive or solvent, or adhesive and solvent, to obtain a slurry. The slurry may be formed and dried to obtain cast leaf material. The method may comprise manufacturing the cast leaf material as described. Alternatively, pre-produced cast leaf material could be used. Using cast leaf material as sheet material may facilitate forming the rod, as the cast leaf material may be conveniently supplied to the production process in a continuous manner, for example from a supply roll. Cast leaf material may be easy to manufacture, transport and store. Using cast leaf as sheet material may simplify the process of forming the rod due to comparatively high tensile strength of cast leaf material. Using tobacco cast leaf may ensure efficient nicotine delivery upon consumption. Cast leaf material may be manufactured at least partly from broken or physically damaged herbaceous material.

The method may comprise crimping the sheet material upstream of the converging device. Crimping the sheet material may facilitate shaping the sheet material into the rod-shape. If the sheet material is crimped, the sheet material may be more likely to form folds upon shaping the sheet material. Folds in sheet material may serve to receive additive dispensed onto the sheet material.

The shaping into a rod-shape of a particular section of the sheet material within the converging device may begin before the additive is dispensed onto the particular section of the sheet material. The shaping into a rod-shape of a particular section of the sheet material within the converging device may finish after the additive has been dispensed onto the particular section of the sheet material. The additive may be dispensed onto a particular section of the sheet material, while the particular section of the sheet material is undergoing shaping within the converging device. If the additive is dispensed onto a section of the sheet material that is currently shaped within the converging device, the additive may be integrated into the rod-shape upon shaping the rod-shape. The additive may be prompted to be distributed over the sheet material by the movement of the sheet material during shaping of the sheet material.

The additive may be dispensed onto the sheet material at a position within the converging device, at which a maximum diameter of the rod-under-formation is at most 400 percent, or at most 350 percent, or at most 300 percent, or at most 250 percent, or at most 200 percent, or at most 150 percent of a maximum diameter of the final rod-shape upon exiting the converging device. If the additive is dispensed onto the sheet material at a position within the converging device, where the sheet material has already been shaped or compressed to a certain degree, efficient distribution of the additive over the sheet material may be facilitated.

The additive may be dispensed onto the sheet material from within the rod-shape upon shaping the sheet material into the rod-shape. If the additive is dispensed from within the rod-shape, the additive may be distributed over the sheet material from an inner region of the rod-shape with respect to a radial direction. A concentration of additive may be highest in an inner region of the rod-shape and may decrease outwardly with respect to a radial direction. Dispensing the additive from within the rod-shape may ensure that most or (nearly) all of the dispensed additive actually finds its way onto the sheet material, thus reducing waste of additive.

The additive may be dispensed within the converging device through an end section of a pipe. The pipe may allow choosing a location within the converging device where the additive is dispensed, thereby increasing control over the dispensing process. The end section of the pipe may comprise a dispensing opening through which the additive is dispensed. The end section of the pipe may protrude into the converging device, in particular into a forming space of the converging device.

The end section of the pipe may at least essentially extend along the conveying direction. In particular, an angle between the end section of the pipe and the conveying direction may be less than 30 degrees, or less than 20 degrees, or less than 15 degrees, or less than 10 degrees, or less than 5 degrees, or less than 3 degrees, for example. If the end section of the pipe at least essentially extends along the conveying direction, the sheet material is essentially conveyed in parallel to the pipe. The sheet material may be conveyed along the end section of the pipe within the converging device. If the end section of the pipe and the conveying direction are essentially parallel to each, the risk that the sheet material is damaged by contact with the end section of the pipe is reduced. The sheet material may slide along the end section of the pipe. The sheet material may take along additive that is dispensed from the end section of the pipe, thereby facilitating the application of the additive onto the sheet material.

The sheet material may be compressed against the end section of the pipe by the funnel-shape of the converging device. If the sheet material is compressed against the end section of the pipe, transfer of additive dispensed from the end section of the pipe onto the sheet material may be particularly smooth. In particular, the sheet material may be compressed against the end section of the pipe by the funnel-shape of the converging device from around the whole circumference of the end section of the pipe. If the sheet material is compressed against the end section of the pipe from around the whole circumference of the end section of the pipe, all or nearly all of the additive dispensed by the end section of the pipe may be received by the sheet material.

The rod-shape may be formed around the end section of the pipe in an at least essentially coaxial arrangement between the rod and the end section of the pipe. This may reduce the likelihood of damaging the sheet material due to contact with the end section of the pipe and may ensure that all or most of the additive dispensed from the end section of the pipe reaches the sheet material.

An outer circumferential shape of the pipe within the converging device and upstream of the end section of the pipe may be different from an outer circumferential shape of the end section of the pipe. The outer circumferential shape of the pipe may change along the extension of the pipe to account for the different processing conditions along the pipe. The outer circumferential shape of the pipe influences the amount of space that may be occupied by the sheet material at a particular position along the conveying direction within the converging device. The outer circumferential shape of the pipe may change to account for an increasing compression of the sheet material along the conveying direction.

A wall thickness of the end section of the pipe may vary around a circumference of the end section of the pipe. Having a wall thickness that changes around the circumference of the end section of the pipe may allow having thicker regions that stabilize the end section of the pipe and, at the same time, having thinner regions that take less space from the sheet material and therefore reduce the risk of damaging the sheet material and still allow for an efficient compression of the sheet material. Also, a varying wall thickness of the end section of the pipe around a circumference of the end section of the pipe may allow to arrange the inner channel of the pipe more closely to the passing sheet material at the injection location. Thus, application of the additive onto the sheet material may be facilitated.

An outer circumferential surface of the end section of the pipe may have one or more flat portions. One or more flat portions in the outer circumferential surface of the end section of the pipe may facilitate providing one or more portions around the circumference of the end section of the pipe that have a reduced wall thickness. The sheet material may be compressed against the one or more flat portions of the end section.

Upstream of the end section of the pipe, an outer circumferential surface of the pipe may have a circular cross-section. The circular cross section may stabilize the pipe and reduce obstruction by the pipe of the path along which the sheet material is conveyed.

An inner circumferential surface of the end section of the pipe may have a circular cross-section. The circular cross-section may stabilize the pipe and may ensure a smooth and well-distributed flow of additive through the pipe.

An outer diameter of the pipe may decrease along the conveying direction. If the outer diameter of the pipe decreases along the conveying direction, the pipe may give additional space to the sheet material, when the sheet material proceeds along the conveying direction. This may allow the sheet material to be progressively compressed around the pipe along the conveying direction.

The end section of the pipe may be coated. The end section of the pipe may be coated with a friction reducing coating. The coating may form a radially outmost layer of the end section of the pipe. The coating of the end section of the pipe may reduce friction between the sheet material and the end section of the pipe, thereby reducing the likelihood of damaging the sheet material, when conveying the sheet material along the end section of the pipe.

The friction reducing coating may, for example, be a diamond-like-carbon coating (DLC coating).

According to another aspect of the present invention, there is provided a device for producing a rod from sheet material. The device comprises a funnel-shape converging device, a conveyer device and a pipe. The conveyer device is configured to convey sheet material along a conveying direction through the funnel-shaped converging device. The pipe has an end section configured for dispensing an additive from the end section within the converging device. A wall thickness of the end section of the pipe varies around a circumference of the end section of the pipe.

As the additive is dispensed from the end section of the pipe within the converging device, the additive may be dispensed onto the sheet material while the sheet material is shaped within the converging device, thus facilitating distribution of the additive over the sheet material in a controlled and efficient manner.

As the wall thickness of the end section of the pipe varies around the circumference of the end section of the pipe, the pipe comprises portions with a greater wall thickness end portions with a smaller wall thickness around its circumference. The portions of smaller wall thickness may leave an increased amount of space for the sheet material within the converging device. Further, the portions of smaller wall thickness may allow bringing the sheet material particularly near the additive dispensed from the end section of the pipe. The portions having a greater wall thickness may ensure stability and structural integrity of the end section of the pipe.

The additive may be dispensed as a liquid.

The end section of the pipe may comprise a dispensing opening for dispensing the additive. The dispensing opening may be located at an end face of the end section.

The converging device may be configured to shape the sheet material into a rod-shape.

An outer surface of the end section of the pipe may have non-circular cross-section. For example, the cross-section of the outer surface of the end section of the pipe may be triangular, or rectangular, or polygon-shaped. A non-circular outer cross section of the end section of the pipe may provide a wall thickness of the end section of the pipe that varies around the circumference of the end section of the pipe.

An outer circumferential surface of the end section of the pipe may have at least one flat portion. The outer circumferential surface of the end section of the pipe may have curved portions between adjacent flat portions with respect to a circumferential direction.

An angle between a first flat portion of the end section of the pipe and a second flat portion of the end section of the pipe may be between 50 degrees and 70 degrees, or between 55 degrees and 65 degrees, or between 80 degrees and 100 degrees, or between 85 degrees and 95 degrees, for example. The angle may be measured in a cross sectional view with a sectional plane that is perpendicular to the extension direction of the pipe. Between the first flat portion and the second flat portion, there may be a curved portion. The curved portion may support structural integrity of the end section of the pipe.

An inner circumferential surface of the end section of the pipe may have a circular cross-section.

The end section of the pipe may at least essentially extend along the conveying direction. In particular, the end section of the pipe may at least essentially extend in parallel to the conveying direction. The end section of the pipe may at least be essentially straight.

The pipe may comprise a base section provided within the converging device upstream of the end section. The pipe may comprise a bent section connecting the base section with the end section. The bent section may allow the pipe to enter the converging device along a desired direction that may be different from the direction of extension of the end section of the pipe. An angle between a direction of extension of the base section and a direction of extension of the end section may be between 90 degrees and 180 degrees, or between 120 degrees and 160 degrees, or between 130 degrees and 150 degrees, or between 140 degrees and 150 degrees, for example. The base section or the end section, or the base section and the end section, may be straight sections of the pipe.

An outer circumferential shape of the end section of the pipe may be different from an outer circumferential shape of the base section of the pipe. Different outer circumferential shapes may accommodate different functions fulfilled by the base section and the end section of the pipe. In particular, the base section may be shaped to be particularly robust, and the end section may be shaped to be sufficiently robust and to allow compressing the sheet material within the converging device without damaging the sheet material.

An outer circumferential surface of the bent section of the pipe may comprise at least one flat portion. The at least one flat portion may facilitate contact between the sheet material and the pipe with reduced risk of damaging the sheet material.

An outer diameter of the pipe may decrease along the conveying direction.

The end section of the pipe may be coated. In particular, the end section of the pipe may be coated with a friction reducing coating.

The friction reducing coating may be a diamond-like-carbon coating (DLC coating).

The device may further comprise a heater arranged at the pipe outside the converging device. The heater may be configured to heat the additive. Heating the additive may improve the flow characteristics of the additive and may facilitate dispensing the additive through the end section of the pipe. Arranging the heater at the pipe allows heating the additive within the pipe while supplying the additive through the pipe.

The heater may be attached to the converging device.

According to another aspect of the present invention, there is provided a use of a coating to reduce friction between a sheet material and an end section of a pipe. The pipe is adapted for dispensing additive onto the sheet material, while the sheet material is conveyed along and in contact with the end section of the pipe.

Using a coating to reduce friction may reduce the risk of damaging the sheet material when conveying the sheet material in contact with the end section of the pipe.

The sheet material may be circumferentially pressed against the end section of the pipe.

The coating may be a friction reducing coating. The coating may be a diamond-like-carbon coating (DLC coating).

As indicated, according to different aspects, the invention provides a method for producing a rod containing herbaceous material, a device for producing a rod from sheet material, and a use of a coating. The device may be suitable, adapted or configured to carry out the method or to implement the use. Features described with respect to one of the aspects may be transferred to, or combined with, any one of the other aspects.

The term "funnel-shaped" with respect to the converging device means that an area of the cross-section of a forming space of the converging device, in a sectional plane perpendicular to the conveying direction, decreases along the conveying direction. The decrease may be continuous or step-wise, or continuous and step-wise.

The forming space of the converging device may be, but does not have to be, fully enclosed by a wall of the converging device circumferentially around the conveying direction.

The term "herbaceous material" is used to denote material from an herbaceous plant. A "herbaceous plant" is an aromatic plant, where the leaves or other parts of the plant are used for medicinal, culinary or aromatic purposes and are capable of releasing flavor into the aerosol produced by an aerosol-generating article.

The diameter of the rod-shape or the diameter of the rod-under-formation at a specific position along the conveying direction refers to the largest extension of the rod-shape or of the rod-under-formation at the specific position in any direction that is perpendicular to the conveying direction.

The outer diameter of the pipe at a specific position along the length the pipe refers to the largest extension of the pipe at the specific position in any direction that is perpendicular to the direction of extension of the pipe at that particular position.

The invention is defined in the claims. However, below there is provided a non-exhaustive list of non-limiting examples. Any one or more of the features of these examples may be combined with any one or more features of another example, embodiment, or aspect described herein.

Example Ex1: Method for producing a rod containing herbaceous material, comprising the steps of:
- providing a sheet material containing herbaceous material;
- shaping the sheet material into a rod-shape by conveying the sheet material along a conveying direction through a funnel-shaped converging device; and
- dispensing an additive onto the sheet material within the converging device.

Example Ex2: Method according to Example Ex1, wherein the sheet material is a cast of a slurry containing herbaceous material or of a paste containing herbaceous material.

Example Ex3: Method according to Example Ex1 or EX2, wherein the sheet material comprises cut or ground herbaceous material.

Example Ex4: Method according to any one of Examples Ex1 to Ex3, wherein the sheet material comprises at least one of cellulose fibers and glycerin.

Example Ex5: Method according to any one of Examples Ex1 to Ex4, wherein the sheet material has a thickness of less than 1 millimeter, or of less than 0.5 millimeter, or of less than 0.2 millimeter, or of less than 0.1 millimeter, or of less than 0.05 millimeter.

Example Ex6: Method according to any one of Examples Ex1 to Ex 5, wherein the shaping into a rod-shape of a particular section of the sheet material within the converging device begins before the additive is dispensed onto the particular section and finishes after the additive has been dispensed onto the particular section.

Example Ex7: Method according to any one of Examples Ex1 to Ex6, wherein the additive is dispensed onto the sheet material at a position within the converging device, at which a maximum diameter of the rod-underformation is at most 400 percent, or at most 350 percent, or at most 300 percent, or at most 250 percent, or at most 200 percent, or at most 150 percent of a maximum diameter of the final rod-shape upon exiting the converging device.

Example Ex8: Method according to any one of Examples Ex1 to Ex7, wherein the additive is dispensed onto the sheet material from within the rod-shape upon shaping the sheet material into the rod-shape.

Example Ex9: Method according to any one of Examples Ex1 to Ex8, wherein the additive is dispensed within the converging device through an end section of a pipe.

Example Ex10: Method according to Example Ex9, wherein the end section of the pipe at least essentially extends along the conveying direction.

Example Ex11: Method according to Example Ex9 or Ex10, wherein the sheet material is compressed against the end section of the pipe by the funnel-shape of the converging device, in particular from around the whole circumference of the end section.

Example Ex12: Method according to any one of Examples Ex9 to Ex11, wherein the rod-shape is formed around the end section of the pipe in an at least essentially coaxial arrangement between the rod and the end section of the pipe.

Example Ex13: Method according to any one of Examples Ex9 to Ex12, wherein an outer circumferential shape of the pipe within the converging device and upstream of the end section of the pipe is different from an outer circumferential shape of the end section of the pipe.

Example Ex14: Method according to any one of Examples Ex9 to Ex13, wherein a wall thickness of the end section of the pipe varies around a circumference of the end section of the pipe.

Example Ex15: Method according to any one of Examples Ex9 to Ex14, wherein an outer circumferential surface of the end section of the pipe has one or more flat portions.

Example Ex16: Method according to any one of Examples Ex9 to Ex14, wherein an inner circumferential surface of the end section of the pipe has a circular cross-section.

Example Ex17: Method according to any one of Examples Ex9 to Ex15, wherein an outer diameter of the pipe decreases along the conveying direction.

Example Ex18: Method according to any one of Examples Ex9 to Ex17, wherein the end section of the pipe is coated, in particular with a friction reducing coating.

Example Ex19: Method according to Example Ex18, wherein the friction reducing coating is a diamond-like-carbon, DLC, coating.

Example Ex20: Device for producing a rod from sheet material, comprising:

a funnel-shaped converging device;

a conveyor device configured to convey sheet material along a conveying direction through the funnel-shaped converging device; and a pipe having an end section configured for dispensing an additive from the end section within the converging device, wherein a wall thickness of the end section of the pipe varies around a circumference of the end section of the pipe.

Example Ex21: Device according to Example Ex20, wherein an outer surface of the end section of the pipe has a non-circular cross-section.

Example Ex22: Device according to Example Ex20 or Ex21, wherein an outer circumferential surface of the end section of the pipe has at least one flat portion.

Example Ex23: Device according to Example Ex22, wherein an angle between a first flat portion of the end section of the pipe and a second flat portion of the end section of the pipe is between 50 degrees and 70 degrees, or between 55 degrees and 65 degrees, or between 80 degrees and 100 degrees, or between 85 degrees and 95 degrees.

Example Ex24: Device according to any one of Examples Ex20 to Ex23, wherein an inner circumferential surface of the end section of the pipe has a circular cross-section.

Example Ex25: Device according to any one of Example Ex20 to Ex24, wherein the end section of the pipe at least essentially extends along the conveying direction.

Example Ex26: Device according to any one of Examples Ex20 to Ex25, wherein the pipe comprises a base section provided within the converging device upstream of the end section and a bent section connecting the base section with the end section.

Example Ex27: Device according to Example Ex26, wherein an outer circumferential shape of the end section of the pipe is different from an outer circumferential shape of the base section of the pipe.

Example Ex28: Device according to Examples Ex26 or Ex27, wherein an outer circumferential surface of the bent section of the pipe comprises at least one flat portion.

Example Ex29: Device according to any one of Examples Ex20 to Ex28, wherein an outer diameter of the pipe decreases along the conveying direction.

Example Ex30: Device according to any one of Examples Ex20 to Ex29, wherein the end section of the pipe is coated, in particular with a friction reducing coating.

Example Ex31: Device according to Example Ex30, wherein the friction reducing coating is a diamond-like-carbon, DLC, coating.

Example Ex32: Device according to any one of Examples Ex20 to Ex31, further comprising a heater arranged at the pipe outside the converging device.

Example Ex33: Device according to Example Ex32, wherein the heater is attached to the converging device.

Example Ex34: Use of a coating to reduce friction between a sheet material and an end section of a pipe, the pipe being adapted for dispensing an additive onto the sheet material, while the sheet material is conveyed along and in contact with the end section of the pipe.

Example Ex35: Use according to Example Ex34, wherein the sheet material is circumferentially pressed against the end section of the pipe.

Example Ex36: Use according to Example Ex34 or Ex35, wherein the coating is a friction reducing coating, in particular a diamond-like-carbon, DLC, coating.

Example Ex37: Method according to any one of Examples Ex1 to Ex19, wherein the additive is menthol.

Example Ex38: Equipment for the manufacturing of tobacco cast leaf rods comprising the device of any of the examples Ex20 to Ex33.

Examples and embodiments will now be further described with reference to the figures in which.

Figure 1:
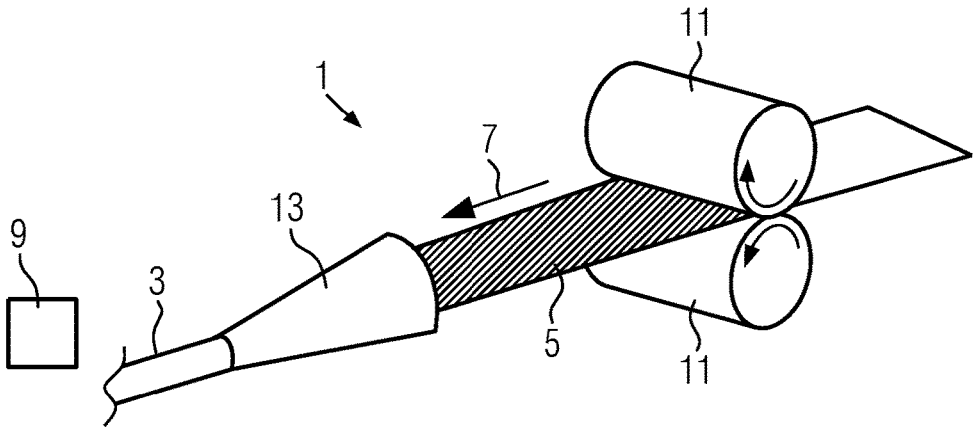
FIG. 1 shows a perspective schematic view of a device for producing a rod from sheet material according to an embodiment.

FIG. 1 shows an overview over a device 1 for producing a rod 3 from sheet material 5 according to an embodiment. Preferably, the sheet material 5 contains herbaceous material, such as tobacco material. The sheet material 5 may comprise reconstituted tobacco material, for example. The sheet material may be cast leaf material, in particular tobacco cast leaf material.

The sheet material 5 is conveyed along a conveying direction 7 by a conveyor device 9, which is schematically shown in FIG. 1. Along the conveying direction 7, the sheet material 5 is first supplied to crimping rollers 11 that crimp the sheet material 5 to facilitate shaping the sheet material 5 into the rod 3 in a converging device 13 downstream of the crimping rollers 11. In the illustrated embodiment, the conveyor device 9 is provided at least partially downstream of the converging device 13 and is configured to convey the sheet material 5 along the conveying direction 7 through the converging device 13. In particular, the conveyor device 9 may pull the sheet material 5 through the converging device 13.

Figure 2:
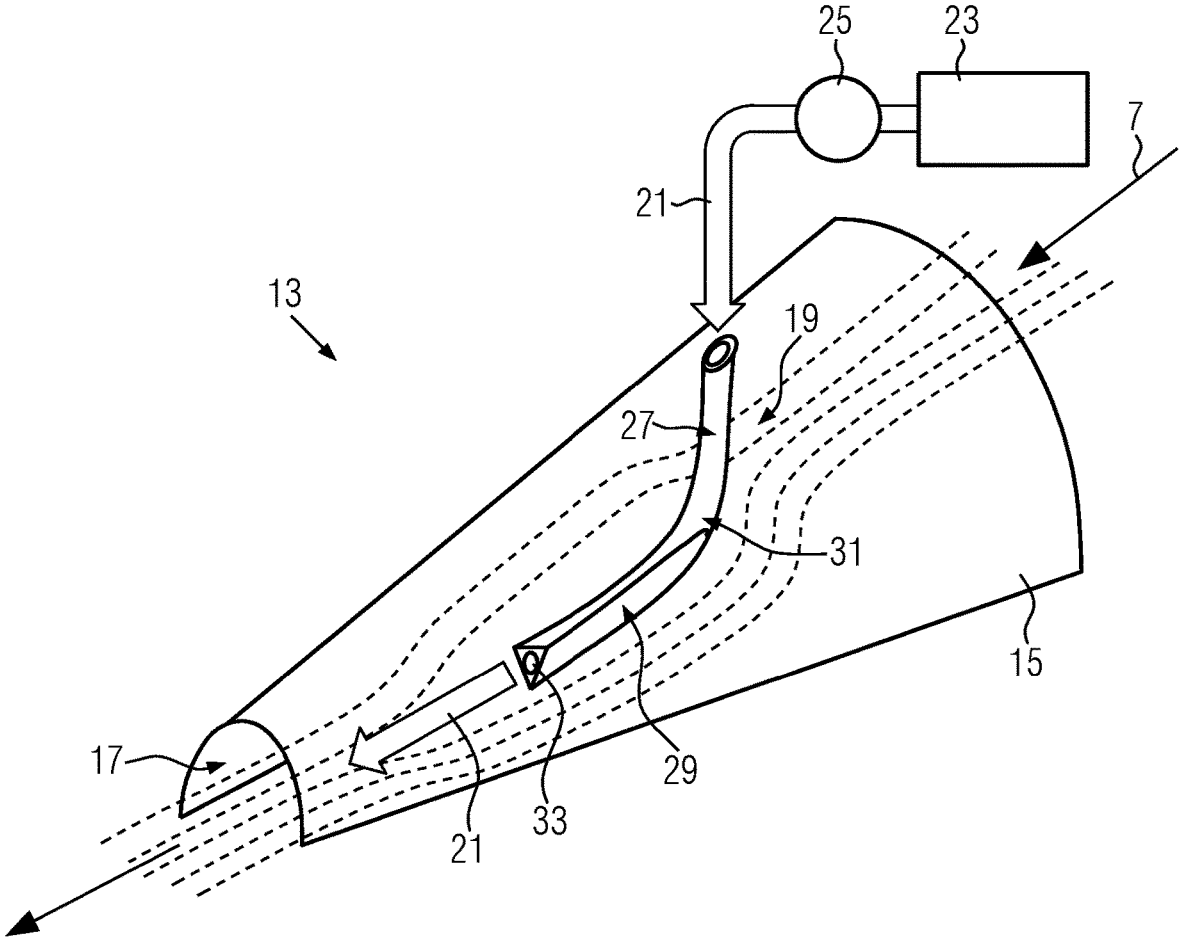
FIG. 2 shows a schematic perspective view of a converging device and an additive dispensing pipe of a device for producing a rod from sheet material according to an embodiment.

FIG. 2 shows a more detailed view of the converging device 13. The converging device 13 is funnel-shaped and has a wall 15 defining a forming space 17. The sheet material 5 is conveyed through the forming space 17 along the conveying direction 7. A cross-sectional area of the forming space 17 in a sectional plane perpendicular to the conveying direction 7 decreases along the conveying direction 7. When the sheet material 5 is conveyed through the converging device 13 along the conveying direction 7, the sheet material 5 engages the wall 15 of the converging device 13 from inside the converging device 13 and is thereby shaped into a rod 3. Shaping the sheet material 5 into the rod 3 may comprise one or more of folding, bending and compressing the sheet material 5.

As illustrated in FIG. 2, it is not required that the converging device 13, in particular the wall 15 of the converging device 13, is fully closed circumferentially around the conveying direction 7. In the illustrated embodiment, the converging device 13 is open at its lower side. Preferably, a support may be provided below the converging device 13, for example in a form of a garnisher belt that is driven in the conveying direction 7 and may support the sheet material 5. It would, however, also be conceivable that the converging device 13 is fully closed circumferentially around the conveying direction 7.

As shown in FIG. 2, a pipe 19 is provided to supply an additive 21 to an inside of the converging device 13, in particular into the forming space 17. In the illustrated embodiment, the pipe 19 enters into the forming space 17 through the wall 15 of the converging device 13 from above. The pipe 19 may be connected to an additive reservoir 23 provided outside the converging device 13. A pump 25 may be provided to pump the additive 21 from the reservoir 23 into the pipe 19. The additive 23 may be supplied as a liquid. The additive 21 may comprise one or more substances to be added to the sheet material 5, such as flavor substances, in particular menthol, nicotine or glycerin, for example.

The pipe 19 comprises a straight base section 27 and a straight end section 29. The base section 27 and the end section 29 are connected by a bent section 31. At a far end of the end section 29, a dispensing opening 33 for dispensing the additive 21 is provided. Preferably, the additive 21 is dispensed through the dispensing opening 33 as a liquid. The dispensing opening 33 is provided at an end face of the pipe 19. The end section 29 of the pipe 19 extends in parallel to the conveying direction 7. Thus, the sheet material 5 is conveyed along and in parallel to the end section 29 of the pipe 19. Due to the narrowing diameter of the converging device 13 along the conveying direction 7, the sheet material 5 is compressed against the outer surface of the end section 29 of the pipe 19. Preferably, the end section 29 of the pipe 19 is positioned such that the sheet material 5 upon being shaped and compressed in the converging device 13 circumferentially surrounds the end section 29 of the pipe 19.

The additive 21 may be continuously dispensed through the dispensing opening 33. When a particular section of the sheet material 5 passes the dispensing opening 33 along the conveying direction 7, additive 21 may be dispensed onto the particular section of the sheet material 5 and may be taken along with the sheet material 5.

According to the illustrated embodiment, the inner circumferential surface of the pipe 19 has a circular cross section. The base section 27 of the pipe 19 within the converging device 13 has an outer circumferential surface that also has a circular cross section. The outer shape of the pipe 19 changes at the bent section 31.

Figure 3:
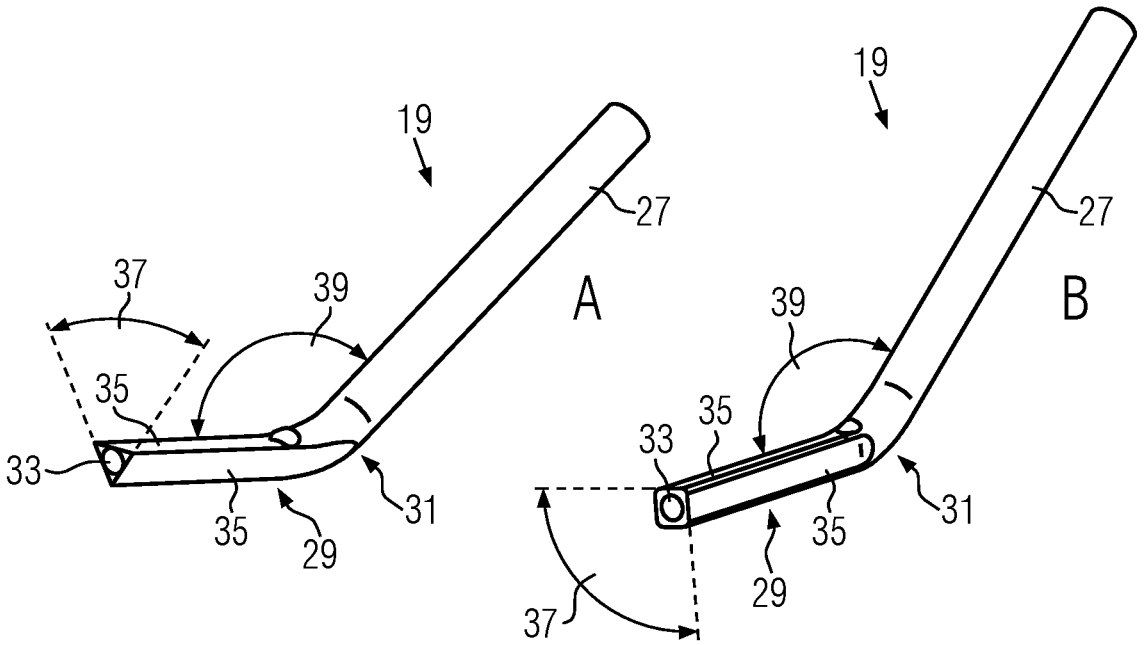
FIG. 3 shows schematic perspective views of the additive dispensing pipe according to two different embodiments.

FIG. 3 shows two alternative versions of the pipe 19 differing from each other due to their outer shapes in the end sections 29 and the bent sections 31. The embodiment illustrated in part A of FIG. 3 essentially corresponds to the embodiment shown in FIG. 2. In the embodiment of part A of FIG. 3, the outer circumferential surface of the pipe 19 comprises three flat portions 35 that extend along the end section 29 of the pipe 19 and into the bent section 31 of the pipe 19. The flat portions 35 are arranged one behind the other along the circumferential direction of the pipe 19. The flat portions 35 each extend from the free end of the pipe 19, which is part of the end section 29, against the conveying direction 7 and into the bent section 31 of the pipe 19. In the embodiment of part A of FIG. 3, the flat portions 35 are directly adjacent to each other (share a common border) along the circumference of the pipe 19. However, it would also be conceivable to, for example, have additional curved or flat portions between adjacent flat portions 35. In the embodiment of part A of FIG. 3, an angle 37 between adjacent flat portions 35 is 60 degrees. The flat portions 35 may, for example, be obtained by removing parts of a cylindrical pipe.

In the embodiment shown in part B of FIG. 3, the outer circumferential surface of the end section 29 of the pipe 19 has four flat portions 35, as compared to the three flat portions 35 shown in part A of FIG. 3. In the embodiment shown in part B of FIG. 3, curved portions of the outer circumferential shape of the pipe 19 lie between adjacent flat portions 35 with respect to the circumferential direction of the pipe 19. As an alternative, the flat portions 35 could be directly adjacent to each other along the circumferential direction of the pipe 19. In part B of FIG. 3, the angle 37 between two adjacent flat portions 35 is 19 degrees. As in part A of FIG. 3, the flat portions 35 shown in part B of FIG.

3 extend against the conveying direction 7 throughout the end section 29 of the pipe 19 and into the bent section 31 of the pipe 19.

In both parts A and B of FIG. 3, at the flat portions 35, the diameter of the pipe 19 is reduced as compared to the diameter of the pipe 19 at the base section 27. This leads to the end section 29 of the pipe 19 being less obstructive to the sheet material 5, when the sheet material 5 is conveyed through the converging device 19. Due to the flat portions 35, the sheet material 5 may be more closely compressed along the end section 29 of the pipe 19. As the flat portions 35 extend into the bent section 31 of the pipe 19, the sheet material 5 may smoothly part around the pipe 19 and move along the end section 29 of the pipe 19.

As can be seen from FIG. 3, a wall thickness of the end section 29 of the pipe 19 varies around the circumference of the end section 29 of the pipe 19. The wall of the end section 29 becomes relatively thin in the middle of the flat portions 35 when seen in the circumferential direction and becomes relatively thick near the ends of the flat portions 35 with respect to the circumferential direction. Comparatively thicker portions of the wall provide the end section 29 of the pipe 19 with stability. The comparatively thin wall sections allow the sheet material 5 to pass the dispensing opening 33 at a close distance.

The angle 39 defined between the end section 29 and the base section 27 of the pipe 19 may be between 140 degrees and 150 degrees, for example.

The end section 29 of the pipe 19 may be fully or partially coated with a friction reducing coating, such as a diamond-like-carbon coating (DLC coating).

Figure 4:
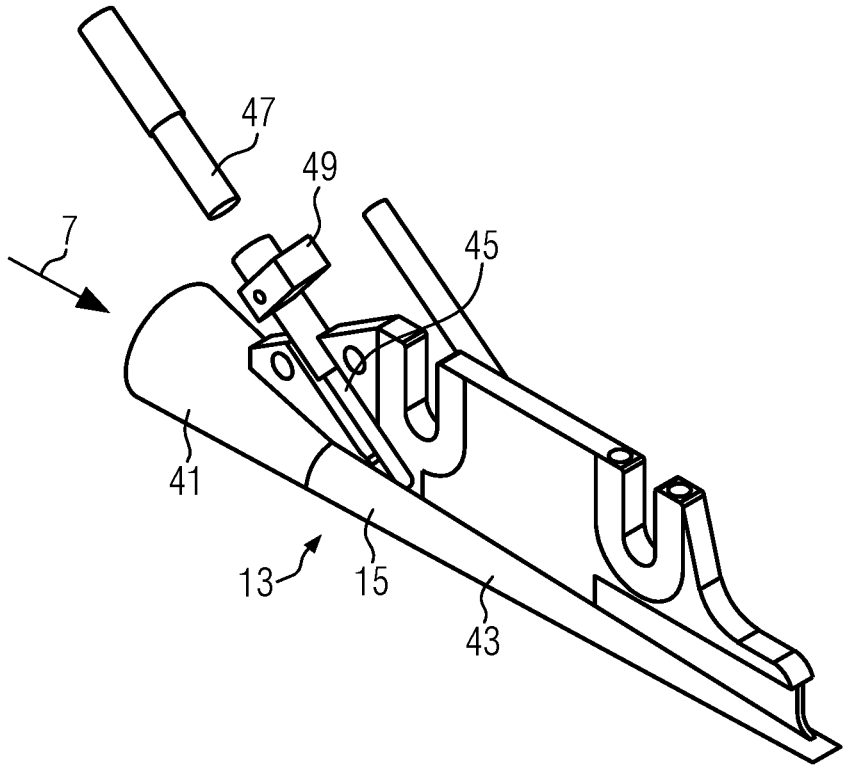
FIG. 4 shows a schematic perspective view of a converging device of a device for producing a rod from sheet material according to an embodiment.

FIG. 4 illustrates how the pipe 19 may be mounted to the converging device 13. In the illustrated embodiment, the converging device 13 comprises two parts 41, 43 that are arranged one behind the other along the conveying direction 7. Alternatively, the converging device 13 could comprise only one part or more than two parts. FIG. 4 shows a connecting section 45 of the pipe 19 extending through the wall 15 of the converging device 13 towards to an outside of the converging device 13. The connecting section 45 of the pipe 19 is configured to be connected with a fluid line 47 connecting the pipe 19 with the pump 25 and the reservoir 23. A heater 49 is provided at the connecting section 45 of the pipe 19 to heat the additive 21 within the pipe 19. The heater 49 is attached to the converging device 13 via the connecting section 45 of the pipe 19. Alternatively, the heater 49 could, for example, be directly connected to the converging device 13.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A±10 percent of A. Within this context, a number A may be considered to include numerical values that are within general standard error for the measurement of the property that the number A modifies. The number A, in some instances as used in the appended claims, may deviate by the percentages enumerated above provided that the amount by which A deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. A method for producing a rod containing herbaceous material, comprising the steps of:
   - providing a sheet material containing herbaceous material;
   - shaping the sheet material into a rod-shape by conveying the sheet material along a conveying direction through a funnel-shaped converging device; and
   - dispensing an additive onto the sheet material within the converging device;
   - wherein the sheet material is a cast of a slurry containing herbaceous material or of a paste containing herbaceous material;
   - wherein the additive is dispensed as a liquid;
   - wherein the liquid flows on the sheet material,
   - wherein the additive is dispensed within the converging device through an end section of a pipe; and
   - wherein a wall thickness of the end section of the pipe varies around a circumference of the end section of the pipe, and wherein the pipe comprises a base section provided within the converging device upstream of the end section and a bent section connecting the base section with the end section.

2. The method according to claim 1, wherein the sheet material comprises cut or ground herbaceous material.

3. The method according to claim 1, wherein the sheet material comprises at least one of cellulose fibers and glycerin.

4. The method according to claim 1, wherein the sheet material has a thickness of less than 0.2 millimeter.

5. A method for producing a rod containing herbaceous material, comprising the steps of:
   - providing a sheet material containing herbaceous material;
   - shaping the sheet material into a rod-shape by conveying the sheet material along a conveying direction through a funnel-shaped converging device; and
   - dispensing an additive onto the sheet material within the converging device;
   - wherein the sheet material is a cast of a slurry containing herbaceous material or of a paste containing herbaceous material;
   - wherein the additive is dispensed as a liquid;
   - wherein the liquid flows on the sheet material; and
   - wherein the additive is dispensed onto the sheet material at a position within the converging device, at which a maximum diameter of the rod-under-formation is at most 400 percent of a maximum diameter of the final rod-shape upon exiting the converging device.

6. A method for producing a rod containing herbaceous material, comprising the steps of:
   - providing a sheet material containing herbaceous material;
   - shaping the sheet material into a rod-shape by conveying the sheet material along a conveying direction through a funnel-shaped converging device; and
   - dispensing an additive onto the sheet material within the converging device;
   - wherein the sheet material is a cast of a slurry containing herbaceous material or of a paste containing herbaceous material;
   - wherein the additive is dispensed as a liquid;
   - wherein the liquid flows on the sheet material;
   - wherein the additive is dispensed within the converging device through an end section of a pipe; and wherein the rod-shape is formed around the end section of the pipe in an at least essentially coaxial arrangement between the rod and the end section of the pipe.

7. A method for producing a rod containing herbaceous material, comprising the steps of:

providing a sheet material containing herbaceous material;

shaping the sheet material into a rod-shape by conveying the sheet material along a conveying direction through a funnel-shaped converging device; and dispensing an additive onto the sheet material within the converging device;

wherein the sheet material is a cast of a slurry containing herbaceous material or of a paste containing herbaceous material;

wherein the additive is dispensed as a liquid;

wherein the liquid flows on the sheet material;

wherein the additive is dispensed within the converging device through an end section of a pipe; and wherein an outer circumferential shape of the pipe within the converging device and upstream of the end section of the pipe is different from an outer circumferential shape of the end section of the pipe.

8. A method for producing a rod containing herbaceous material, comprising the steps of:

providing a sheet material containing herbaceous material;

shaping the sheet material into a rod-shape by conveying the sheet material along a conveying direction through a funnel-shaped converging device; and dispensing an additive onto the sheet material within the converging device;

wherein the sheet material is a cast of a slurry containing herbaceous material or of a paste containing herbaceous material;

wherein the additive is dispensed as a liquid;

wherein the liquid flows on the sheet material;

wherein the additive is dispensed within the converging device through an end section of a pipe; and wherein an outer diameter of the pipe decreases along the conveying direction.

9. A method for producing a rod containing herbaceous material, comprising the steps of:

providing a sheet material containing herbaceous material;

shaping the sheet material into a rod-shape by conveying the sheet material along a conveying direction through a funnel-shaped converging device; and dispensing an additive onto the sheet material within the converging device;

wherein the sheet material is a cast of a slurry containing herbaceous material or of a paste containing herbaceous material;

wherein the additive is dispensed as a liquid;

wherein the liquid flows on the sheet material;

wherein the additive is dispensed within the converging device through an end section of a pipe; and wherein the end section of the pipe is coated with a friction reducing coating.

10. A method for producing a rod containing herbaceous material, comprising the steps of:

providing a sheet material containing herbaceous material;

shaping the sheet material into a rod-shape by conveying the sheet material along a conveying direction through a funnel-shaped converging device; and dispensing an additive onto the sheet material within the converging device;

wherein the sheet material is a cast of a slurry containing herbaceous material or of a paste containing herbaceous material;

wherein the additive is dispensed as a liquid;

wherein the liquid flows on the sheet material;

wherein the additive is dispensed within the converging device through an end section of a pipe; and wherein an angle between the end section of the pipe and the conveying direction is less than 10 degrees.

11. A device for producing a rod from sheet material, comprising:

a funnel-shaped converging device;

a conveyor device configured to convey sheet material along a conveying direction through the funnel-shaped converging device; and a pipe having an end section configured for dispensing an additive from the end section within the converging device, wherein a wall thickness of the end section of the pipe varies around a circumference of the end section of the pipe; and wherein the pipe comprises a base section provided within the converging device upstream of the end section and a bent section connecting the base section with the end section.

12. The device according to claim 11, wherein an outer surface of the end section of the pipe has a non-circular cross-section.

13. The device according to claim 11, wherein an outer circumferential surface of the end section of the pipe has at least one flat portion.

14. Device according to claim 13, wherein an angle between a first flat portion of the end section of the pipe and a second flat portion of the end section of the pipe is between 50 degrees and 70 degrees, or between 55 degrees and 65 degrees, or between 80 degrees and 100 degrees, or between 85 degrees and 95 degrees.

15. The device according to claim 11, wherein an outer circumferential shape of the end section of the pipe is different from an outer circumferential shape of the base section of the pipe.

16. The device according to claim 11, wherein an outer circumferential surface of the bent section of the pipe comprises at least one flat portion.

17. The device according to claim 11, wherein an outer diameter of the pipe decreases along the conveying direction.

18. The device according to claim 11, wherein the end section of the pipe is coated, in particular with a friction reducing coating.

* * * * *